US005269153A

United States Patent [19]

Cawley

[11] Patent Number: 5,269,153

[45] Date of Patent: Dec. 14, 1993

[54] APPARATUS FOR CONTROLLING SPACE HEATING AND/OR SPACE COOLING AND WATER HEATING

[75] Inventor: Richard E. Cawley, Lafayette, Ind.

[73] Assignee: Artesian Building Systems, Inc., Lafayette, Ind.

[21] Appl. No.: 6,674

[22] Filed: Jan. 19, 1993

Related U.S. Application Data

[63] Continuation of Ser. No. 703,876, May 22, 1991, abandoned.

[51] Int. Cl.[5] ..... F25B 27/02

[52] U.S. Cl. ..... 62/180; 62/324.1; 62/238.7; 165/103

[58] Field of Search ..... 62/324.1, 238.7, 160, 62/180, 181, 185; 237/2 B; 165/35, 103

[56] References Cited

U.S. PATENT DOCUMENTS

| | | | |
|---|---|---|---|
| 4,399,664 | 8/1983 | Derosier | 62/238.7 |
| 4,528,822 | 7/1985 | Glamm | 62/324.1 X |
| 4,766,734 | 8/1988 | Dudley | 62/160 |
| 4,809,516 | 3/1989 | Jones | 62/160 |
| 4,943,003 | 7/1990 | Shimizu et al. | 237/2 B |

*Primary Examiner*—Albert J. Makay
*Assistant Examiner*—William C. Doerrler
*Attorney, Agent, or Firm*—Leydig, Voit & Mayer

[57] ABSTRACT

A heating and cooling system integrated with a domestic water heating system wherein the heating and cooling system utilize recaptured heat and direct that heat back into the system for domestic water heating. Various paths for exchanging heat from refrigerant to water are utilized to provide space heating or space cooling with simultaneous water heating, and water heating alone when there are no space cooling or space heating demands.

7 Claims, 2 Drawing Sheets

APPARATUS FOR CONTROLLING SPACE HEATING AND/OR SPACE COOLING AND WATER HEATING

This is a continuation of copending application Ser. No. 07/703,876 filed on May 22, 1991 abandoned.

FIELD OF THE INVENTION

The invention relates to heating and cooling systems in general. More particularly the invention relates to heating and cooling systems integrated with a water heating system wherein the heating and cooling system utilizes recaptured heat and directs that heat back into the system for water heating.

BACKGROUND OF THE INVENTION

There are available on the market today heat pumps which utilize a compressed refrigerant and can be combined with domestic water heating. These systems operate in either a refrigerant desuperheating or condensing mode to provide hot water while simultaneously providing space heating or cooling. Additionally these systems provide hot water in a refrigerant condensing mode when no space cooling or space heating is required. The cost for these types of devices is high and puts them out of the reach of average consumers. Furthermore the complexity of such systems is beyond the comprehension of most of the local HVAC contractors and therefore makes their installation expensive.

In contrast, relatively inexpensive systems or field added components provide for the integration of water heating by desuperheating refrigerant while the system is cooling a space or heating a space and the heat pump has excessive heating capacity. This type of system is much less expensive and less complex than the first system described. However, it only provides domestic water heating if there is a simultaneous cooling or heating demand from the conditioned space.

SUMMARY OF THE INVENTION

The present invention overcomes the deficiencies and complexity of the prior art. More particularly the present invention is directed to a heating and cooling system that provides space heating or cooling with simultaneous water heating, and water heating alone when there are no space cooling or space heating demands.

The present invention includes an outdoor coil and fan, an indoor and outdoor throttling and check assembly, and indoor coil and blower, a compressor and a refrigerant reversing valve to change the direction of the flow of refrigerant through the system depending on whether a demand for space heating or space cooling exists. Additionally the system is integrated with a water heating system through a plurality of water and refrigerant heat exchangers aligned with the discharge line of the compressor. The water heating portion of the present invention includes a water storage tank or a conventional water heater, a water pump, and diverter valve for directing the water to a variety of contact points with the refrigerant for exchanging heat. Alternatively, multiple solenoid or other diverting means may be used to direct the water.

A straightforward control scheme regulates the positioning of the diverter valve and the reversing valve in response to specific heating, cooling, and/or water heating demands. Selective positioning of the reversing valve and the diverter valve allows space cooling or space heating, to be combined with domestic water heating by either condensing or desuperheating a refrigerant. Additionally, the cooperative relationship of the reversing valve and the diverter valve also produces the functions of space heating, space cooling, and water heating exclusively.

The amount of heat exchanged with the water is adjusted by changing the number of heat exchangers the flow of water contacts and thereby either accomplishing desuperheating or condensing of the refrigerant. Furthermore, by changing the paths taken by the water and the refrigerant respectively the system heats domestic water without the need for the system to be operating in the space cooling or space heating mode. The paths taken by the water and refrigerant depend on the desired function to be accomplished.

BRIEF DESCRIPTION OF THE DRAWINGS

The present invention will be better understood from a review of the detailed description of the illustrative embodiments with reference to the drawings in which.

DETAILED DESCRIPTION OF THE PREFERRED EMBODIMENT

Figure 1:
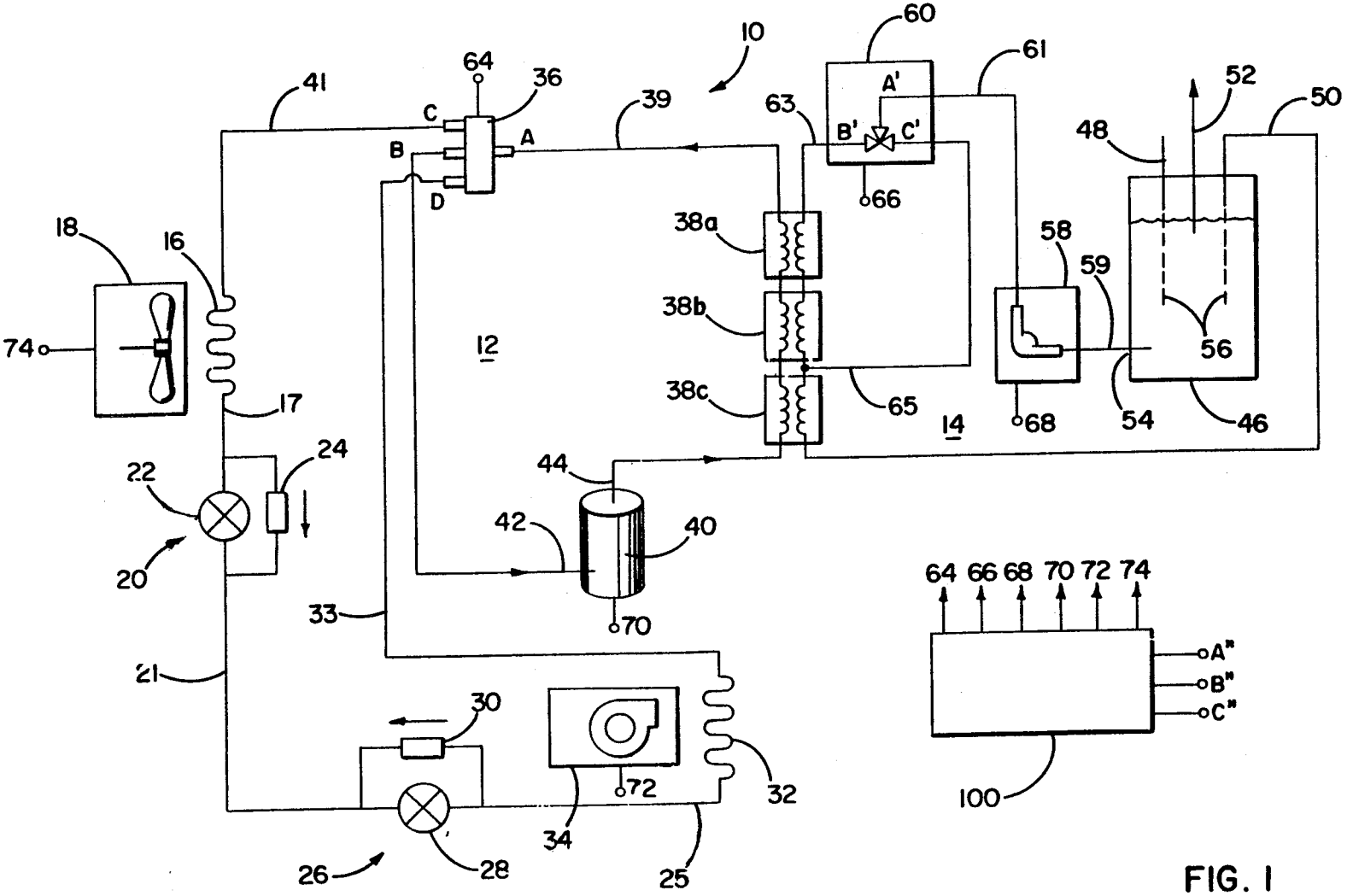
FIG. 1 is a schematic diagram showing the present invention.

As shown in FIG. 1 the system 10 is an integration of a heat pump space heating and/or cooling unit 12 and water heating unit 14. The system 10 uses the space heating and cooling functions of a conventional heat pump system 12 and integrates the heat pump system 12 with a water heating system 14. It is the control of the cooperative relationship between the heat pump system 12 and the water heating system 14 that allows the system 10 as a whole to perform space heating, space cooling, and water heating functions separately or in combinations of space cooling and water heating, and space heating and water heating.

The preferred embodiment is described in relation with a heat pump system for convenience. It should be understood that the application of the present invention can be utilized by other conventional heating systems such as combustion assisted heat pump systems, and the like.

The heat pump heating and cooling system 12 comprises an outdoor coil 16 and fan 18 for exchanging heat from the refrigerant to the ambient for cooling purposes or for absorbing heat from the ambient for space heating purposes. The outdoor coil 16 is connected by tubing to an outdoor throttling and check assembly 20.

In the preferred embodiment the outdoor throttling and check assembly 20 consists of a thermal expansion valve 22 and check valve 24. Alternative embodiments of the throttling and check assembly may include any throttling and/or check valve combinations employed in the HVAC industry including but not limited to combination fixed-orifice and check valves, capillary tubes and check valves, and check valves combined with fixed subcooling or constant pressure controls.

The outdoor throttling and check assembly 20 is connected by a line 21 to an indoor throttling and check assembly 26. Again, the preferred embodiment comprises a thermal expansion valve 28 and check valve 30, and alternative embodiments may include any of the throttling and check valve combinations previously described.

Connected by tubing denoted by a line 25 to the indoor throttling and check assembly 26 is indoor coil 32 and blower 34. The indoor coil 32 and blower 34 provide a means for exchanging heat between the refrigerant and the air for accomplishing space heating and cooling. Blower 34 and coil 32 may be any conventional component utilized by the heating and air conditioning industry. The type and size of the coil and blower will depend upon the size of the area to be heated and cooled.

The indoor coil 32 has tubing denoted by a line 33 connecting it with a reversing valve 36. Reversing valve 36 may be any conventional valve commonly used in the HVAC industry. Reversing valve 36 is utilized to change the direction of the refrigerant flow depending on whether a demand for space cooling, space heating or water heating exists. The reversing valve 36 includes four apertures A,B,C, and D which are opened and/or closed to provide several combinations of inlets and outlets for the refrigerant as it flows through the reversing valve 36. The different combinations of inlets and outlets direct the compressed refrigerant along different routes to produce the different functions of space heating, space cooling and water heating.

The reversing valve 36 is connected by tubing denoted by a line 39 to a series of refrigerant to water heat exchangers 38*a*, 38*b* and 38*c*. The heat exchangers 38 may be of any commercially available type. In the preferred embodiment the refrigerant flows through a series of three series connected refrigerant to water heat exchangers 38, however the number of heat exchangers 38 can be increased or decreased to meet design needs. Alternatively, the heat exchanger may consist of a single refrigerant to water heat exchanger having multiple water tubing connections, thus accomplishing the same function.

A compressor 40 has a suction line 42 and discharge line 44. The refrigerant to water heat exchanger 38*c* is connected to the discharge line 44 of compressor 40. The discharge line 44 supplies the heated refrigerant to the heat exchangers 38 allowing for the transfer of heat to the water.

In the preferred embodiment Aperture A of the reversing valve 36 is connected by refrigerant tubing on the line 39 to refrigerant to water heat exchanger 38*a*. Aperture B is connected to the suction line 42 of compressor 40. Aperture C is connected by refrigerant tubing denoted by a line 41 to outdoor coil 16. Aperture D is connected by refrigerant tubing denoted by line 33, to the indoor coil 32.

Integrated with the heating and cooling system 12 is a water heating system 14. The water heating system includes a water storage tank 46 having a cold water inlet 48, a hot water inlet 50, a hot water outlet 52 and an outlet 54. The water tank 46 also includes heating elements 56 that are used as a supplemental heat source if the water is not being sufficiently heated by the refrigerant to water heat exchangers 38*a–c*.

The outlet 54 of the water storage tank 46 is connected by tubing to water pump 58. Water pump 58 is in turn connected by tubing denoted by a line 59 to diverter valve 60. Diverter valve 60 has three openings designated as A', B', and C'. The diverter valve 60 is connected via a line 61 to the refrigerant to water heat exchanger 38. The diverter valve 60 is connected to the heat exchanger 38*a* by a line 63 selectively allows the flow of water pumped from the water storage tank 46 to pass through all of the heat exchangers 38*a–c*, which condenses some or all of the refrigerant from the compressor 40, or a portion of the heat exchangers 38 to desuperheat the refrigerant. In the condensing mode, more heat is added to the water than the amount of heat added when the system is in the desuperheating mode.

Aperture A' of diverter valve 60 is connected by water tubing denoted by the line 61 to pump 58. Aperture B' is connected via the line 63 to refrigerant to water heat exchangers 38*a*. Aperture C' is connected at some predetermined intermediate point along the series of refrigerant to water heat exchangers 38*a–c*. In the preferred embodiment aperture C' is connected at a point between, refrigerant to water heat exchangers 38*b* and 38*c* via a line 65. Alternatively there may be any number of heat exchangers 38 and C' may be connected between a given number of the heat exchangers such that the water exiting through C' does not receive heat from the entire series of heat exchangers 38.

In the preferred embodiment diverter valve 60 is an electrically operated valve such as the Honeywell V8044E1011 Fan Coil Valve utilized in the Artesian Building Systems Mac=Pac heating systems. Alternatively the diverter valve may encompass a plurality of solenoid valves or any other device which is capable of selectively exposing the flow of water to a variety of refrigerant heat exchange contact paths.

The heating and cooling system 12 also includes a control device 100 that activates the heating and cooling system in response to conventional thermostatic control signals produced in response to a demand for space heating and space cooling and is additionally responsive to demands for water heating. As shown schematically in FIG. 1 control 100 receives input signals A" corresponding to a demand for space heating, B" corresponding to a demand for space cooling and C" corresponding to a demand for water heating. Each input signal A", B" and C" is produced by a conventional thermostatic control. Control 100 coordinates the entire heating and cooling system to achieve the results demanded by the inputs A", B", C" by utilizing the logic illustrated in the flow chart of FIG. 2.

Figure 2:
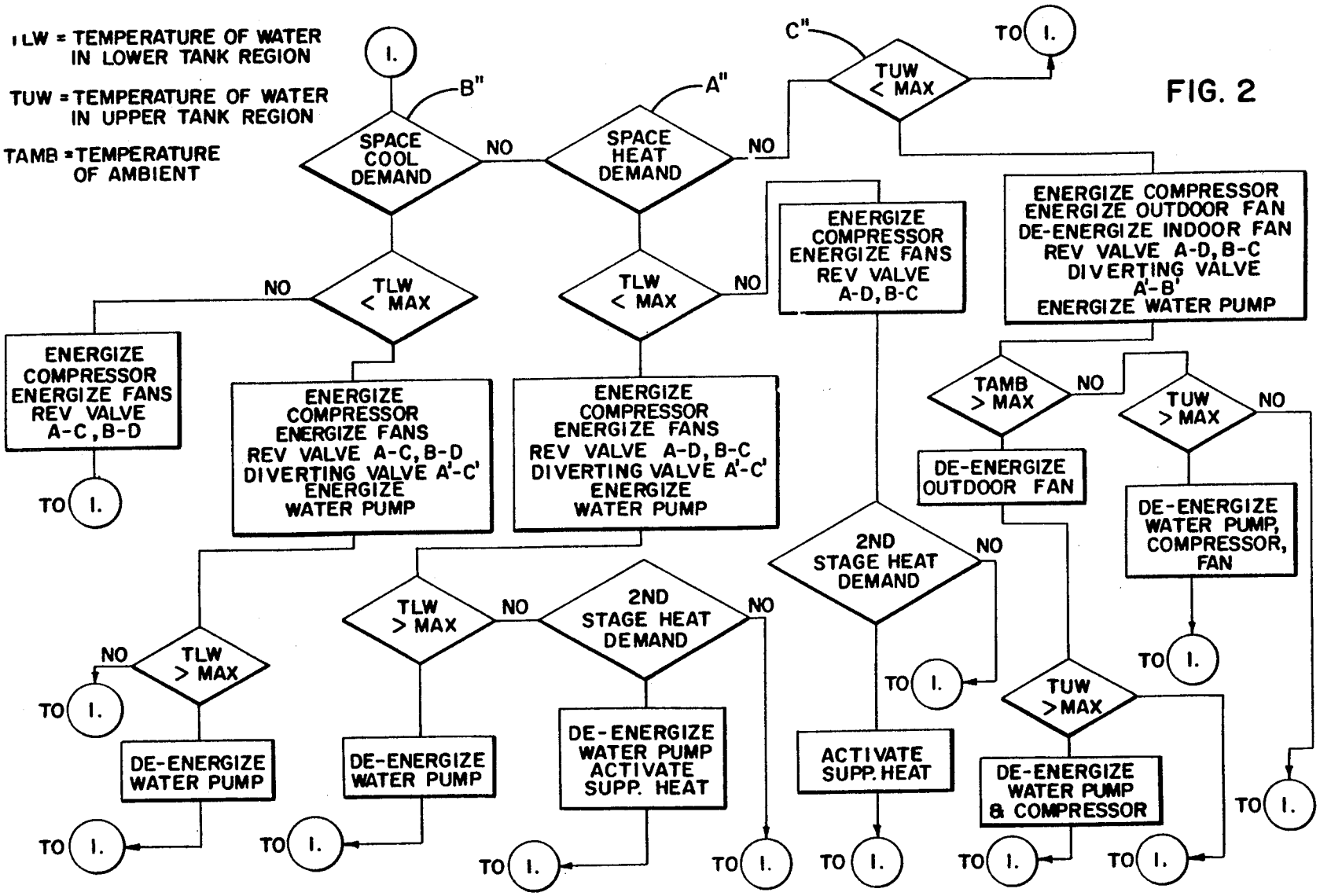
FIG. 2 is a flow chart diagram illustrating the control scheme of the present invention.

The logic flow chart of FIG. 2 includes a series of yes/no questions corresponding to demands for space cooling, space heating and water heating and combinations thereof as well as actions responsive to those demands to achieve the desired demands of space cooling, space heating and water heating. The actions responsive to the demands are enclosed in rectangular boxes in the flow chart of FIG. 2 and correspond to the energization of lines 64 through 74 of control 100 illustrated in FIG. 1. The energization of these output signals are well known in the art.

The control 100 also controls the positions of diverter valve 60 and reversing valve 36 to obtain the optimum efficiency for the system depending on what combinations of space heating, space cooling and water heating are demanded.

The control 100 may be any control means such as microprocessor based, discreet component electronics, electromechanical or a combination of these devices capable of actuating or positioning each component of the heating and cooling system to a predetermined position or status depending on the function to be achieved. The actual details of control 100 are within the ability of one skilled in the art depending upon the control structure chosen and accordingly are not described in detail. For example, in the preferred embodiment shown in FIG. 1, control 100 would actuate or position each component of the heating and cooling system 10 in response to an input signal using the logic described in the flow chart of FIG. 2. The practical results of control 100 utilizing the logic of FIG. 2 showing the status or position of each component depending on the specific function to be accomplished are illustrated in Table 1.

TABLE 1

| Made | Description | Reversing Valve | Compressor | Water Pump | Diverting Valve | Indoor Fan | Outdoor Fan |
|---|---|---|---|---|---|---|---|
| I | Cooling/ Water heating (Desuperheating) | A-C B-D | on | on | A'-C' | on | on |
| Ia | Cooling/ Water heating (Condensing) | A-C B-D | on | on | A'-B' | on | on |
| II | Cooling only | A-C B-D | on | off | A'-C' or A'-B' | on | on |
| III | Heating/ Water heating (Desuperheating) | A-D B-C | on | on | A'-C' | on | on |
| IIIa. | Heating/ Water heating (Condensing) | A-D B-C | on | on | A'-B' | on | on |
| IV | Heating only | A-D B-C | on | off | A'-C' or A'-B' | on | on |
| V | Water Heating Only | A-D B-C | on | on | A'-B' | off | on or off |
| VI | No space or water demand | Previous position | off | off | Previous position | off | off |

Referring to Table 1, the column entitled description lists the possible combinations of space heating, space cooling and water heating functions that the heating and cooling system is capable of producing. The control 100 activates the components to their designated position in response to the description desired, as is well known in the art.

For example, in Mode I, there is a demand for space cooling and water heating. Control 100 sends a signal on line 70 to the compressor 40. Upon receipt of this signal the compressor is actuated compressing the refrigerant thereby heating the refrigerant. Control 100 also sends a signal on line 64 to reversing valve 36. Upon receipt of this signal the reversing valve 36 is arranged so the flow of heated refrigerant from the refrigerant to water heat exchangers 38 enters aperture A and exits through aperture C. The refrigerant also enters aperture D and exits through aperture B. The control 100 also sends a signal on line 66 to diverter valve 60. Upon receipt of this signal the diverter valve 60 is arranged so water from tank 46 enters aperture A' and exits through Aperture C'.

This arrangement of the reversing valve 36 and diverter valve 60 accomplishes both the functions of space cooling and water heating. Compressed refrigerant exits through discharge line 44 from compressor 40 and flows through the series of refrigerant to water heat exchangers 38*a–c*. Simultaneously, pump 58 receives a signal from control 100 on line 68 which turns pump 58 on. Water is pumped from the water storage tank 46 to diverter valve 60 entering aperture A' and exiting through aperture C'. The water flows out of aperture C' to only one of the refrigerant to water heat exchangers 38*c*. The refrigerant is desuperheated and the water receives heat from the refrigerant. The heated water is then returned to the water storage tank through inlet 50.

The refrigerant is desuperheated by exchanging heat with the water in the refrigerant to water heat exchanger 38*c* and continues flowing to the outdoor coil 16 where heat from the refrigerant is exchanged with the ambient by blowing air from fan 18 across the outdoor coil 16. The fan 18 receives a signal from control 100 on line 74 which turns fan 18 on. The refrigerant is then vaporized by indoor throttling device 28 causing a significant decrease in the temperature of the refrigerant. The cooled refrigerant then flows to the indoor coil 32 where blower 34 moves warmer air over the coil such that the vaporized, cold refrigerant absorbs heat from the warmer forced air. The blower 34 receives a signal from controller 100 on line 72 which turns blower 34 on. Thus the function of space cooling is accomplished. The refrigerant then flows to the reversing valve 36 entering through aperture D and exiting aperture B which is connected to the suction line 42 of the compressor 40 to repeat the process until the present demand for cooling and water heating no longer exists.

The present invention is also capable of operating in a water heating mode without either a demand for space heating or space cooling. Corresponding to the desired function of water heating only Table 1, row V indicates in which position control 100 will move the component parts of the system. Control 100 reaches this result by using the logic illustrated in FIG. 2.

When there is a demand for water heating only control 100 sends a signal on line 68 to pump 58. Upon receipt of this signal pump 58 is activated pumping water from storage tank 46. Additionally, control 100 sends a signal on line 66 to diverter valve 60. Upon receipt of this signal the diverter valve 60 is arranged so that water pumped from water storage tank 46 enters aperture A' and exits through aperture B'. The water exits aperture B' and flows through all of the refrigerant to water heat exchangers 38*a–c*.

The heated water is then returned to the water storage tank 46. Simultaneously, control 100 sends a signal on line 64 to reversing valve 36. Upon receipt of this signal, reversing valve 36 is positioned so the flow of heated refrigerant enters aperture A and exits aperture D. Refrigerant also enters aperture C and exits aperture B.

In operation compressed refrigerant exits through the discharge line 44 of compressor 40 flowing through the entire series of refrigerant to water heat exchangers 38*a–c*. Because the diverter valve 60 has directed the flow of water through the entire series of refrigerant to water heat exchangers 38*a–c* the water is maintained in contact with the heated refrigerant for a maximum period.

The refrigerant continues to flow through the system entering reversing valve 36 through aperture A. The reversing valve 36 is positioned so heated refrigerant enters aperture A and exits through aperture D. The refrigerant continues on its designated path flowing to the indoor coil 32. When there is only a demand for water heating control 100 does not actuate blower 34 thus no significant gain or loss of heat occurs as the refrigerant flows through the indoor coil 32.

The refrigerant flows through the indoor check valve 30 and outdoor throttling device 22 and through the outdoor coil 16 where it absorbs heat from the ambient. In the preferred embodiment fan 18 receives a signal from control 100 on line 74 which turns fan 18 on. Alternatively control 100 will not send a signal to fan 18 if the ambient is within designated parameters to maintain the efficiency of the system. The refrigerant next enters the reversing valve 36 through aperture C and exits through aperture B and where it is directed to the suction line 42 of compressor 40 to repeat the process.

Control 100 using the parameters and logic of the flow chart of table 2 with the practical results listed in table 1 selectively positions and actuates the components of the system to direct the flow of refrigerant and water on a variety of refrigerant to water heat exchange contact path to achieve the functions of space heating, space cooling, and water heating separately, and combinations of space heating and water heating and space cooling and water heating. This unique concept of supplying simple logic controls to a heating or cooling system having a variety of refrigerant to water contact paths allows the system to achieve combinations of space heating, space cooling and water heating as well as space heating, space cooling and water heating functions exclusive.

What is claimed is:

1. Apparatus for integrating a heat pump system having a refrigerant for heating or cooling a space and a water heating system comprising a first refrigerant circulation path having first and second points of connection coupling a compressor for compressing said refrigerant, and a plurality of refrigerant to water heat exchangers;

a second refrigerant circulation path including first and second points of connection coupling outdoor heat exchange means for exchanging heat between said refrigerant and the ambient, indoor heat exchange means for exchanging heat between refrigerant and air for heating or cooling a space, and expansion valve means for evaporating said refrigerant;

refrigerant directing means for selectively coupling said first point of connection of said first circulation path with said first point of connection of said second circulation path and said second point of connection of said first circulation path with said second point of connection of said second circulation path in a first mode of operation, and for selectively coupling said first point of connection of said first circulation path with aid second point of connection of said second circulation path and said second point of connection of said first circulation path with said first point of connection of said second circulating path in a second mode of operation;

a first water circulation path coupling a storage tank, a water pump, and water directing means for selectively directing water to said plurality of refrigerant to water heat exchangers;

temperature sensing means for providing sensing signals indicative of demands for space heating, space cooling, and water heating; and control means for receiving said sensing signals and for providing a first output signal for positioning said refrigerant directing means in said first mode, for providing a second output signal for positioning said refrigerant directing means in said second mode, and for providing a third output signal for positioning said water directing means for directing water to said plurality of refrigerant to water heat exchangers.

2. The invention as in claim 1 wherein said control means provides a fourth output signal for actuating or deactuating said compressor in response to said sensing signal.

3. Apparatus of claim 1 wherein said refrigerant directing means is a reversing valve.

4. Apparatus for integrating a heat pump system having a refrigerant for heating or cooling a space and a water heating system comprising a first refrigerant circulation path having first and second points of connection for coupling a compressor for compressing said refrigerant, and a plurality of refrigerant to water heat exchangers;

a second refrigerant circulation path including first and second points of connection for coupling outdoor heat exchange means for exchanging heat between said refrigerant and the ambient, indoor heat exchange means for exchanging heat between refrigerant and air for heating or cooling a space, and expansion valve means for evaporating said refrigerant;

refrigerant directing means for selectively coupling said first point of connection of said first circulation path with said first point of connection of said second circulation path with said second point of connection of said first circulation path with said second point of connection of said second circulation path in a first mode of operation, and for selectively coupling said first point of connection of said first circulation path with said second point of connection of said second circulation path and said point of connection of said first circulation path with said first point of connection of said second circulating path in a second mode of operation;

a first water circulation path coupling a storage tank, a water pump, and water directing means for selectively directing water to said plurality of refrigerant to water heat exchangers in a first mode;

a second water circulation path coupling at least one of said refrigerant to water heat exchangers, said water directing means, and said water tank and water pump when said water directing means is in a second mode; and control means responsive to demands for space heating, space cooling, and water heating for providing a first output signal for operating said refrigerant directing means in said first mode, for providing a second output signal for operating said refrigerant directing means in said second mode, for providing a third output signal for operating said water directing means in said first mode, and for providing a fourth output signal for operating said water directing means in said second mode.

5. The invention as in claim 2 wherein said control means provides a fifth output signal for actuating or deactuating said outdoor heat exchange means in response to said sensing signals.

6. The invention as in claim 5 wherein said control means provides a sixth output signal for actuating or deactuating said expansion valve means in response to said sensing signals.

7. The invention as in claim 6 wherein said control means provides a seventh output signal for actuating or deactuating said water pump in response to said sensing signals.

* * * * *